US009581101B2

(12) United States Patent
Huber

(10) Patent No.: US 9,581,101 B2
(45) Date of Patent: Feb. 28, 2017

(54) METHOD FOR INTERNAL COMBUSTION ENGINE FUEL INJECTION COMPUTATION BASED ON FUEL AGING

(71) Applicant: Robert Bosch GmbH, Stuttgart (DE)

(72) Inventor: Martin Huber, Marbach Am Neckar (DE)

(73) Assignee: ROBERT BOSCH GMBH, Stuttgart (DE)

( * ) Notice: Subject to any disclaimer, the term of this patent is extended or adjusted under 35 U.S.C. 154(b) by 85 days.

(21) Appl. No.: 13/852,248

(22) Filed: Mar. 28, 2013

(65) Prior Publication Data

US 2013/0261933 A1 Oct. 3, 2013

(30) Foreign Application Priority Data

Mar. 28, 2012 (DE) ..... 10 2012 204 975

(51) Int. Cl.
*F02D 41/30* (2006.01)
*F02D 41/24* (2006.01)

(52) U.S. Cl.
CPC ..... *F02D 41/30* (2013.01); *F02D 41/2454* (2013.01); *F02D 41/3005* (2013.01); *F02D 2200/0414* (2013.01); *F02D 2200/0611* (2013.01); *F02D 2200/0612* (2013.01)

(58) Field of Classification Search
CPC ..... F02D 2200/0414; F02D 41/2454; F02D 41/30
USPC ..... 123/1 A, 478, 479, 480, 494, 516, 517, 123/518, 519, 520, 587; 701/103, 104, 701/105, 114, 115
See application file for complete search history.

(56) References Cited

U.S. PATENT DOCUMENTS 5,085,197 A * 2/1992 Mader ..... F02M 25/0809 123/516
6,305,360 B1 * 10/2001 Hurley ..... F02D 41/0032 123/516
6,352,065 B1 * 3/2002 Wild ..... F02D 41/0072 123/494
6,363,916 B2 * 4/2002 Kawakami ..... F02D 41/061 123/491
6,516,786 B2 * 2/2003 Krimmer ..... F02M 25/08 123/516
6,644,285 B2 * 11/2003 Bayerle ..... F02D 19/0628 123/491
6,679,225 B2 * 1/2004 Robertson ..... F02D 19/0631 123/436
6,817,342 B2 * 11/2004 Schule ..... F02D 19/0631 123/486
6,840,234 B2 * 1/2005 Lederer ..... F02M 25/0809 123/516
7,000,602 B2 * 2/2006 Cullen ..... F02D 41/0082 123/478
7,059,313 B2 * 6/2006 Lippa ..... F02P 5/1502 123/518

(Continued)

*Primary Examiner* — Stephen K Cronin
*Assistant Examiner* — Kevin R Steckbauer
(74) *Attorney, Agent, or Firm* — Gerard Messina

(57) ABSTRACT

A method for the injection computation for an internal combustion engine, in particular for a gasoline range extender engine. This includes ascertaining an adaptation factor, which represents fuel aging, from a model of the fuel and a fuel outgassing via a tank vent and adaptation of a fuel injection quantity and/or a fuel injection time using the adaptation factor.

10 Claims, 1 Drawing Sheet

(56) References Cited

U.S. PATENT DOCUMENTS 7,159,623 B1 * 1/2007 Carr ..... F02D 19/0628 123/516
7,163,002 B1 * 1/2007 Halverson ..... F02D 41/064 123/480
7,690,364 B2 * 4/2010 Grunwald ..... F02D 41/0045 123/516
7,980,342 B2 * 7/2011 Andri ..... B60L 11/123 123/480
8,090,520 B2 * 1/2012 Tate, Jr. ..... B60K 6/48 180/65.28
8,109,076 B2 * 2/2012 Colet ..... F02M 65/008 123/1 A
8,240,412 B2 * 8/2012 Andri ..... B60L 11/123 123/478
8,290,684 B2 * 10/2012 Yuen ..... B60K 6/46 123/1 A
8,321,158 B2 * 11/2012 Proefke ..... G01N 33/2835 702/183
8,694,186 B2 * 4/2014 Syed ..... F02D 41/0025 180/65.265
8,789,514 B2 * 7/2014 Caretta ..... F02D 35/023 123/299
8,818,692 B2 * 8/2014 Iraha ..... B60K 6/365 180/65.28
9,115,665 B2 * 8/2015 Syed ..... F02D 41/0025
2003/0213475 A1 * 11/2003 Robertson ..... F02D 19/0631 123/491
2005/0133013 A1 * 6/2005 Lippa ..... F02P 5/1502 123/685
2005/0224055 A1 * 10/2005 Wiese ..... F02D 41/0025 123/494
2009/0107441 A1 * 4/2009 Husak ..... F02D 41/062 123/179.16
2009/0114288 A1 * 5/2009 Grant ..... F02D 19/0628 137/88
2009/0178474 A1 * 7/2009 Bailey ..... F02D 19/0628 73/114.38
2009/0321159 A1 * 12/2009 Andri ..... B60L 11/123 180/65.25
2009/0321164 A1 * 12/2009 Andri ..... B60L 11/123 180/65.265
2010/0139252 A1 * 6/2010 Colet ..... F02M 65/008 60/286
2010/0256931 A1 * 10/2010 Proefke ..... G01N 33/2835 702/55
2013/0030616 A1 * 1/2013 Syed ..... F02D 41/0025 701/22
2014/0163842 A1 * 6/2014 Syed ..... F02D 41/0025 701/104
2015/0142297 A1 * 5/2015 Kojima ..... F02D 41/3076 701/104

* cited by examiner

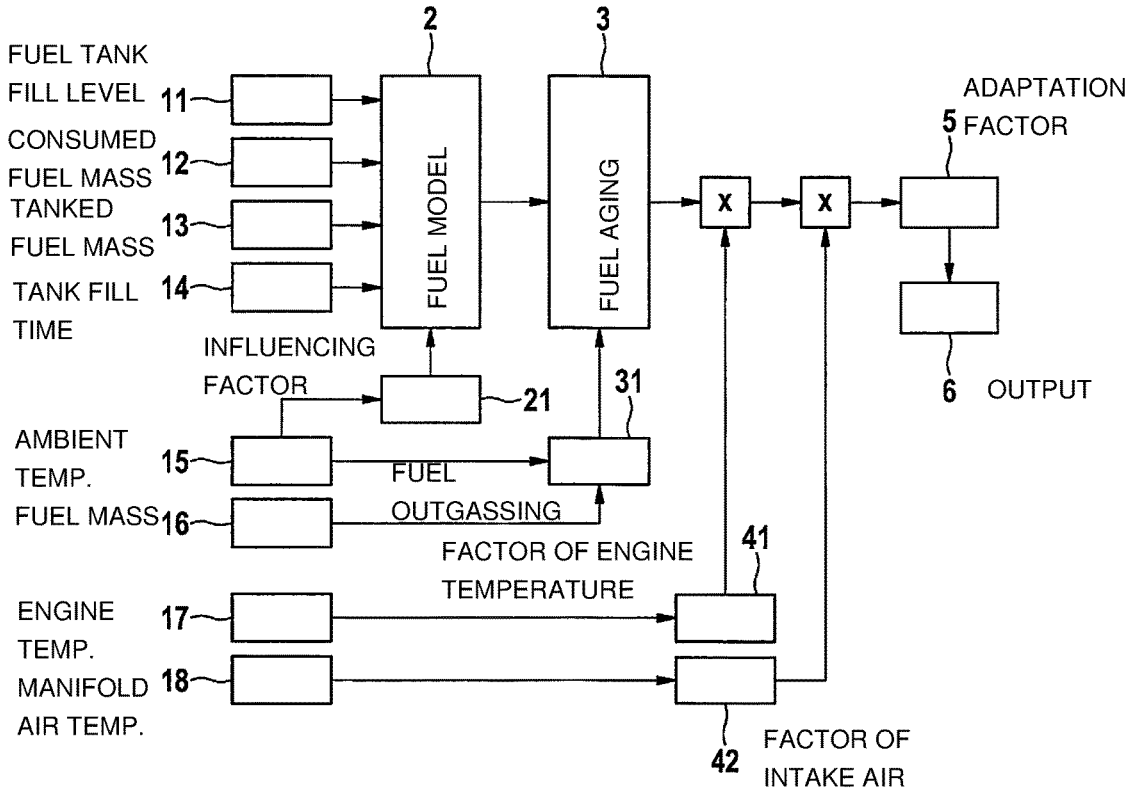
2
3
FUEL TANK
FILL LEVEL 11
CONSUMED
FUEL MASS 12
TANKED
FUEL MASS 13
TANK FILL
TIME 14
FUEL MODEL
FUEL AGING
x
x
ADAPTATION
5 FACTOR
6 OUTPUT
INFLUENCING
FACTOR
21
31
AMBIENT
TEMP. 15
FUEL
OUTGASSING
FUEL MASS 16
FACTOR OF ENGINE
TEMPERATURE
41
ENGINE
TEMP. 17
MANIFOLD
AIR TEMP. 18
42
FACTOR OF
INTAKE AIR

METHOD FOR INTERNAL COMBUSTION ENGINE FUEL INJECTION COMPUTATION BASED ON FUEL AGING

CROSS REFERENCE

The present application claims the benefit under 35 USC §119 of German Patent Application No. DE 102012204975.4 filed on Mar. 28, 2012, which is expressly incorporated herein by reference in its entirety.

FIELD

The present invention relates to a method for the injection computation for an internal combustion engine, in particular for a gasoline range extender engine. In addition, the present invention relates to a computer program which executes all the steps of the method according to the present invention when it is running on a computer. Finally, the present invention relates to a computer program product having program code stored on a machine-readable carrier, for carrying out the method according to the present invention when the program is executed on a computer.

BACKGROUND INFORMATION

Motor vehicles driven by an electric motor are increasingly being developed and manufactured by the automotive industry. The electrical power for operating the electric motor for driving the electric vehicle is obtained from a battery situated in the electric vehicle. The battery is charged on an electrical power grid while the electric vehicle is parked. The electric vehicle has a battery charger for this purpose. The capacity for storing electrical power in the battery is limited here, so that only cruising ranges of approximately 50 kilometers to 200 kilometers are reachable by the electric vehicle.

To increase the cruising range of an electric vehicle, it is often equipped with a so-called range extender. This is an internal combustion engine generator unit. For longer driving distances of an electric vehicle, during which the battery cannot be charged adequately or at all from a power grid, the battery is charged with the aid of the internal combustion engine generator unit and/or electrical power is supplied to the electric motor with the aid of the internal combustion engine generator unit. The possible cruising range of such an electric vehicle having a range extender may therefore be increased to distances of approximately 600 kilometers, corresponding to a cruising range of traditional motor vehicles driven exclusively by an internal combustion engine.

However, the goal is to utilize the internal combustion engine as little as possible to thereby minimize fuel consumption. It may absolutely happen that the internal combustion engine is not used for several months or is turned on only sporadically. During this period of time, the fuel in the tank will outgas and undergo aging. Aging of fuel has effects on the combustion performance of the internal combustion engine. Problems may therefore occur in particular when starting the internal combustion engine and misfiring may occur during operation.

SUMMARY

An example method according to the present invention for the injection computation for an internal combustion engine, in particular for a gasoline range extender engine, includes ascertaining an adaptation factor which represents fuel aging.

The adaptation factor is ascertained from a model of the fuel and fuel outgassing through a tank vent. In addition, the method includes the adaptation of a fuel injection quantity and/or a fuel injection time using the adaptation factor. Reliable starting of the internal combustion engine and operation of the internal combustion engine without misfiring are ensured by taking into account the adaptation factor in computing the injection quantity and/or the injection time.

The model of the fuel uses as the input variables in particular a fuel tank filling level, a fuel mass consumed, a tanked fuel mass, a tank filling time and an influencing factor for taking into account a fluctuation in temperature over time. The age of the fuel may be ascertained on the basis of the fuel mass in the tank and the tank filling time. When refilling the tank with fuel, a new fuel factor representing fuel aging is preferably formed from the fuel mass added to the fuel tank during refilling in relation to the fuel mass still in the tank. In addition, this preferably also takes into account how often and how much the fuel in the tank has been heated during its time in the tank. Fuel ages less rapidly at very low temperatures than at very high temperatures.

Fuel outgassing is computed in particular from the ambient temperature and a fuel mass released via tank venting. Fuel tends to outgas at a greater rate at higher ambient temperatures.

The adaptation factor may be modeled, for example, on the basis of the fuel model or a fuel factor generated from the fuel model and the fuel outgassing on the basis of the data input of an engine characteristics map. This adaptation factor is not expressed in units and may be included in the mixture control of an internal combustion engine by multiplication. The adaptation factor of unaged fuel has a value of 1. The older the fuel and the greater the outgassing through the tank vent, the greater the adaptation factor becomes. The original injection quantity is increased by this value. If the adaptation factor is used for shifting the injection time, then it is shifted by an offset. Generally, injection may be performed somewhat earlier here because the aged mixture is not dispersed very well because it lacks volatile components.

When the internal combustion engine has an intake manifold injector in particular, it is preferable for the temperature of the internal combustion engine to be taken into account in ascertaining the adaptation factor. In addition, in ascertaining the adaptation factor, it is preferable for the temperature of the air drawn in through an intake manifold by an internal combustion engine to be taken into account. This takes into account the fact that fuel is not dispersed as well at a low temperature and will also condense on the wall of the intake manifold.

An example computer program according to the present invention, which executes all the steps of the method according to the present invention when it is running on a computer, makes it possible to implement the method according to the present invention in an existing internal combustion engine without having to make any structural changes in the engine. The computer program product according to the present invention having program code stored on a machine-readable carrier for carrying out the method according to the present invention when the program is executed on a computer or a control unit is therefore used for this purpose.

BRIEF DESCRIPTION OF THE DRAWING

An exemplary embodiment of the present invention is illustrated in the FIGURE and explained in greater detail below.

FIG. 1 shows a flow chart for ascertaining an adaptation factor in a method according to one specific embodiment of the present invention.

DETAILED DESCRIPTION OF EXAMPLE EMBODIMENTS

FIG. 1 schematically shows the sequence of a method for the injection computation for a gasoline range extender engine having an intake manifold gasoline injection according to one specific embodiment of the present invention. With the aid of a tank filling level sensor, a fuel tank filling level 11, a consumed fuel mass 12 and a tanked fuel mass 13 are ascertained. These variables are used together with a tank filling time 14 as input variables for a fuel model 2. An influencing factor 21 for taking into account a temperature fluctuation over time is ascertained from ambient temperature 15 and is used as an input variable for fuel model 2. Fuel model 2 and fuel outgassing 31 are used as input variables for a model for fuel aging 3. Fuel aging 3 is computed from ambient temperature 15 and a fuel mass 16 released through a tank vent. The model of fuel aging 3 outputs a dimensionless factor of fuel aging which is multiplied by a dimensionless factor of internal combustion engine temperature 41, which is ascertained from the temperature of internal combustion engine 17. In addition, a multiplication takes place by a dimensionless factor of intake air 42, which is ascertained from the temperature of air 18 drawn in by the internal combustion engine through an intake manifold. The multiplication by these three factors results in an adaptation factor 5. This adaptation factor 5 has a value of 1 for unaged fuel, and increases to a value of 1.1 with outgassing through the tank vent, for example.

The fuel injection quantity of the range extender is adapted (represented by box 6 in FIG. 1) by multiplying it by this adaptation factor 5. Alternatively, the fuel injection time is shifted to an earlier injection by an offset depending on this adaptation factor 5. More reliable starting of the range extender engine may be ensured by the example method according to the present invention. Combustion misfiring or worsening of the exhaust gas values may be prevented by using this example method.

What is claimed is:

1. A method for fuel injection control for an internal combustion engine, comprising:

ascertaining an adaptation factor, which represents an aging of fuel, from a model of the fuel and from fuel outgassing via a tank vent; and controlling, using the adaptation factor, at least one of a fuel injection quantity and a fuel injection time of injected fuel;

wherein the model of the fuel aging uses as at least one input variable an influencing factor for taking into account ambient temperature fluctuation over time, and wherein the adaptation factor representing aging of fuel is determined additionally by multiplying factors representing a temperature of the internal combustion engine and a temperature of air drawn in through an intake manifold by the internal combustion engine, wherein a fuel aging is computed from an ambient temperature and a fuel mass released through a tank vent, wherein the model of fuel aging outputs a dimensionless factor of fuel aging which is multiplied by a dimensionless factor of an internal combustion engine temperature, which is ascertained from the temperature of the internal combustion engine, wherein a multiplication takes place by a dimensionless factor of intake air, which is ascertained from the temperature of air drawn in by the internal combustion engine through the intake manifold, wherein the adaptation factor has a value of 1 for unaged fuel, and increases with fuel age and outgassing through the tank vent, and wherein the engine is a range extender engine.

2. The method as recited in claim 1, wherein the model of the fuel uses as additional input variables a fuel tank filling level, a consumed fuel mass, a tanked fuel mass, and a tank filling time.

3. The method as recited in claim 1, wherein a fuel injection quantity of the range extender engine is adapted by multiplying it by the adaptation factor.

4. The method as recited in claim 1, wherein a fuel injection time is shifted to an earlier injection by an offset depending on the adaptation factor.

5. A non-transitory, computer readable medium storing a computer program, which is executable by a processor, comprising:

a program code arrangement having program code for providing fuel injection control for an internal combustion engine, by performing the following:

ascertaining an adaptation factor, which represents an aging of fuel, from a model of the fuel and from fuel outgassing via a tank vent; and controlling, using the adaptation factor, at least one of a fuel injection quantity and a fuel injection time of injected fuel;

wherein the model of the fuel aging uses as at least one input variable an influencing factor for taking into account ambient temperature fluctuation over time, and wherein the adaptation factor representing aging of fuel is determined additionally by multiplying factors representing a temperature of the internal combustion engine and a temperature of air drawn in through an intake manifold by the internal combustion engine, wherein a fuel aging is computed from an ambient temperature and a fuel mass released through a tank vent, wherein the model of fuel aging outputs a dimensionless factor of fuel aging which is multiplied by a dimensionless factor of an internal combustion engine temperature, which is ascertained from the temperature of the internal combustion engine, wherein a multiplication takes place by a dimensionless factor of intake air, which is ascertained from the temperature of air drawn in by the internal combustion engine through the intake manifold, wherein the adaptation factor has a value of 1 for unaged fuel, and increases with fuel age and outgassing through the tank vent, and wherein the engine is a range extender engine.

6. The computer readable medium as recited in claim 5, wherein a fuel injection quantity of the range extender engine is adapted by multiplying it by the adaptation factor.

7. The computer readable medium as recited in claim 5, wherein a fuel injection time is shifted to an earlier injection by an offset depending on the adaptation factor.

8. A control unit to control a fuel injector of an internal combustion engine, comprising:

an ascertaining arrangement to ascertain an adaptation factor, which represents aging of fuel, from a model of the fuel and from fuel outgassing via a tank vent;

a controlling arrangement to control, using the adaptation factor, at least one of a fuel injection quantity and a fuel injection time of injected fuel;

wherein the model of the fuel aging uses as at least one input variable an influencing factor for taking into account ambient temperature fluctuation over time, wherein the adaptation factor representing an aging of the fuel is determined by multiplying factors representing a temperature of the internal combustion engine and a temperature of air drawn in through an intake manifold by the internal combustion engine, wherein a fuel aging is computed from an ambient temperature and a fuel mass released through a tank vent, wherein the model of fuel aging outputs a dimensionless factor of fuel aging which is multiplied by a dimensionless factor of an internal combustion engine temperature, which is ascertained from the temperature of the internal combustion engine, wherein a multiplication takes place by a dimensionless factor of intake air, which is ascertained from the temperature of air drawn in by the internal combustion engine through the intake manifold, wherein the adaptation factor has a value of 1 for unaged fuel, and increases with fuel age and outgassing through the tank vent, and wherein the engine is a range extender engine.

9. The control unit as recited in claim 8, wherein a fuel injection quantity of the range extender engine is adapted by multiplying it by the adaptation factor.

10. The control unit as recited in claim 8, wherein a fuel injection time is shifted to an earlier injection by an offset depending on the adaptation factor.

* * * * *